United States Patent [19]

Wedlin

[11] 4,425,986

[45] Jan. 17, 1984

[54] APPARATUS FOR LUBRICATION OF RAILS

[75] Inventor: Per Wedlin, Solna, Sweden

[73] Assignee: AB Erik Bohlin, Solna, Sweden

[21] Appl. No.: 308,676

[22] Filed: Oct. 5, 1981

[30] Foreign Application Priority Data

Oct. 17, 1980 [SE] Sweden ..... 8007317

[51] Int. Cl.[3] ..... B61K 3/02; G01F 11/06

[52] U.S. Cl. ..... 184/3.2; 184/6.28; 184/26; 184/67; 222/309; 417/417

[58] Field of Search ..... 184/3 R, 3 A, 14, 15 A, 184/67, 6.28, 26, 32; 222/309; 417/417, 399; 92/129, DIG. 4; 104/279

[56] References Cited

U.S. PATENT DOCUMENTS

| | | | |
|---|---|---|---|
| 517,127 | 3/1894 | Purvis | 184/64 X |
| 1,105,929 | 8/1914 | Schultheis | 184/67 |
| 1,170,752 | 2/1916 | Hodges | 184/3 R |
| 1,173,656 | 2/1916 | Flanigan | 184/3 R X |
| 1,454,123 | 5/1923 | McClure | 184/67 X |
| 1,662,022 | 3/1928 | Bacon | 184/67 |
| 1,663,590 | 3/1928 | Gourdon | 222/309 X |
| 1,822,668 | 9/1931 | Protzeller | 184/3 R |
| 3,606,098 | 9/1971 | Genther | 184/15 A X |

FOREIGN PATENT DOCUMENTS

| | | | |
|---|---|---|---|
| 101537 | 9/1922 | Fed. Rep. of Germany | 184/3 R |
| 492838 | 7/1919 | France | 184/3 R |
| 303285 | 1/1929 | United Kingdom | 184/67 |
| 234065 | 10/1969 | U.S.S.R. | 184/67 |

*Primary Examiner*—David H. Brown
*Assistant Examiner*—John E. Griffiths, Jr.
*Attorney, Agent, or Firm*—Holman & Stern

[57] ABSTRACT

An apparatus for portional ejection of lubricant for lubrication of railway rails, comprising a tank for lubricant, a dosage pump connected to the tank and driven by an operating unit, a nozzle, and a timer for controlling the operating unit. The operating unit is an electromagnet including a movable armature the movement of which acts upon an ejector piston in the dosage pump. A connecting device is provided between the movable armature of the electromagnet and said ejector piston which establishes a power-transmitting connection only after a predetermined distance of displacement of the armature.

3 Claims, 2 Drawing Figures

APPARATUS FOR LUBRICATION OF RAILS

BACKGROUND OF THE INVENTION

1. Field of the Invention

The present invention relates to an apparatus for portional ejection of lubricant for lubrication of railway rails, comprising a tank for lubricant, a dosage pump driven by means of an operating unit, a nozzle, and a control unit for actuation of the operating unit.

2. Description of the Prior Art

It is known that wear on railway rails as well as on wheel flanges can be reduced to a high degree by application of lubricant, especially grease, on the rails. To this end many solutions have already been proposed, both in the form of stationary means, which supplies lubricant to the rail from a stationary installation, and vehicle-mounted means which by dispensing lubricant on the wheel track lubricates the rail via the wheel track.

A common feature for the great majority of previously known lubricating devices is that they all require supply of pressure medium to function. Both stationary and vehicle-mounted installations utilize as a rule compressed air or other gas kept stored under high pressure in tubes or bottles. Even if one has managed nowadays to reduce the amount of air/gas required per ejection of lubricant by application of a refined regulation technique the exchange and the maintenance of pressure vessels for air/gas involves an obvious inconvenience.

BRIEF SUMMARY OF THE INVENTION

The object of this invention is to provide an apparatus which entirely eliminates the need of compressed air or gas but nevertheless permits ejection of lubricant at the required high pressure. One has earlier considered utilizing the braking air as a source of power but for special reasons this has proved useless for that purpose. Hitherto, however, one has paid no regard to the fact that practically all rail vehicles of interest for mounting of lubrication devices are provided with a lighting current system, usually 24 volt DC, which can be utilized.

The essential characteristic of the apparatus according to the invention resides in that the operating unit of the dosage pump consists of an electromagnet including a moveable armature the movement of which acts upon an ejector piston in the dosage pump, and that there is provided between the movable armature of the electromagnet and said ejector piston, a connecting means which, only after a predetermined distance of displacement of the armature, establishes a power-transmitting connection between the armature and the ejector piston.

BRIEF DESCRIPTION OF THE DRAWING

An embodiment of the apparatus according to the invention will be described in greater detail hereinbelow with reference to the accompanying drawings, wherein.

DETAILED DESCRIPTION

Figure 1:
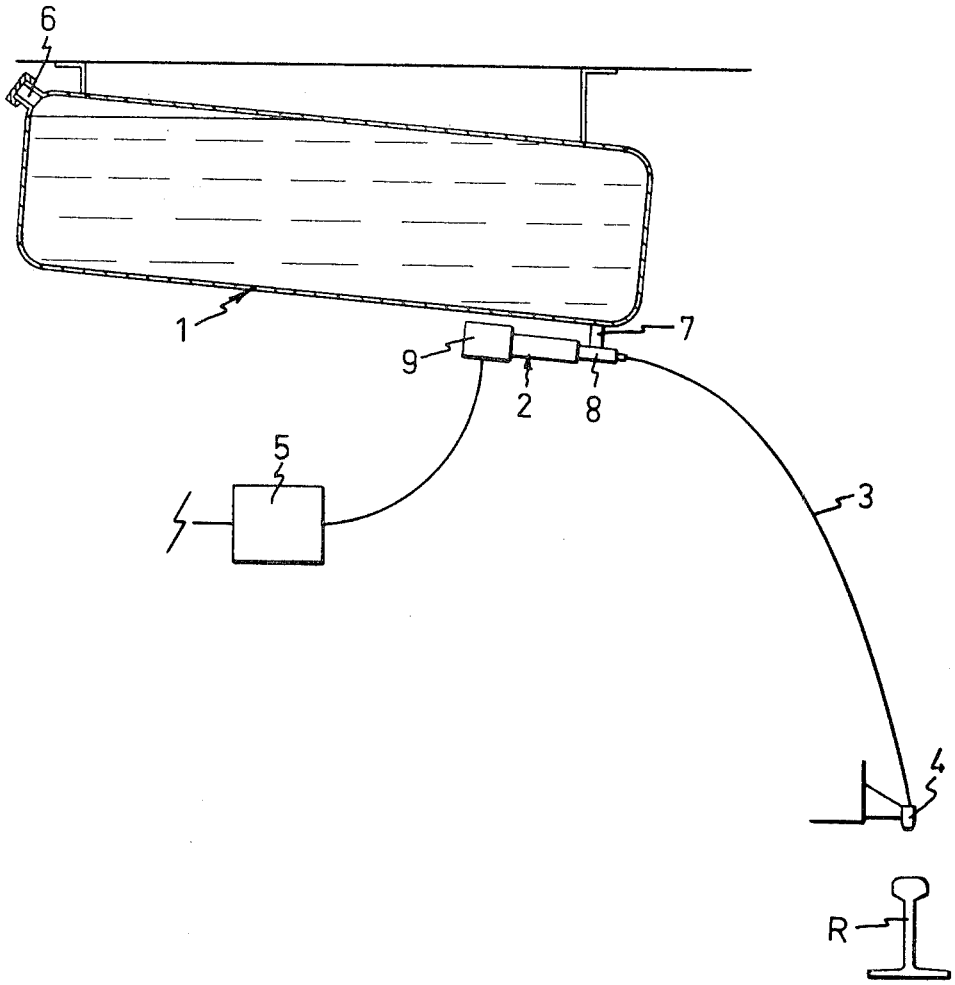
FIG. 1 is a partly cross-sectional and schematic view of an entire installation embodying the invention.

The installation as shown in FIG. 1 includes a lubricant tank 1, an ejector and dosage pump 2 driven by means of an electromagnet, a pressure conduit 3, a nozzle 4 and a timer 5 controlling the pump. The nozzle may also be coupled directly to the pump, whereby the pressure conduit is dispensed with.

The tank 1, which suitably is suspended in the chassis frame of the vehicle, is provided with a filler neck 6 and a discharge opening 7 directly connected to the pump 2. To prevent the lubricant from solidifying when the weather is very cold the tank may be provided with an electric heater with low power requirement, preferably controlled by a thermostat. In exceptional cases the tank may be placed under a low overpressure, about 2 bar, if the lubricant is very viscous. Lubricants generally used for this purpose require for the major part of the year neither heating nor overpressure.

Figure 2:
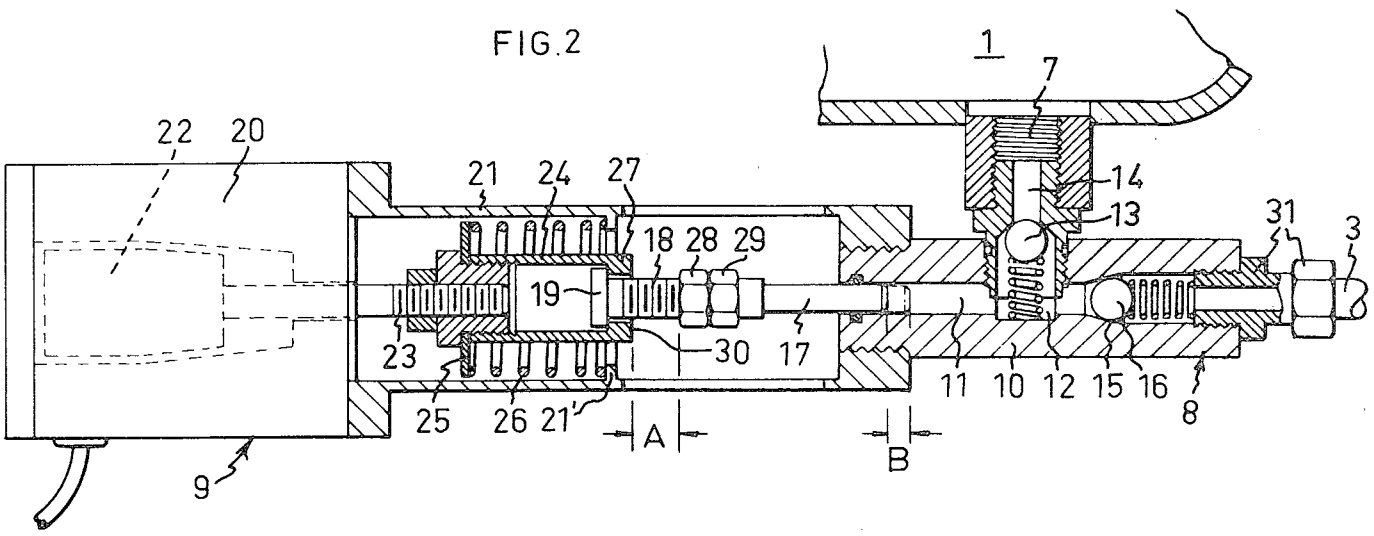
FIG. 2 is a cross-sectional view on a larger scale of the lubricant dosage or ejector pump included in the installation of FIG. 1.

The pump shown in detail in FIG. 2 consists of a dosage and ejector section 8, previously known in principle, and an operating section 9.

The ejector section 8 consists of a housing 10 which at one end has an accurately elaborated cylindrical bore 11 which merges in a wider portion 12 into which a transverse passage 14 with a non-return valve 13 opens. Upstream of the non-return valve 13 the passage 14 is connected with the outlet 7 of the tank.

Arranged in line with the bore 11, on the other side of the portion 12, is a conically flared portion 15 in which another non-return valve 16 is provided. Downstream of this non-return valve 16 is a nipple 31 to which the pressure conduit 3 and/or the nozzle are connected.

An ejector piston 17 is slidably fitted in the cylindrical bore 11 and connected with a threaded rod 18 which is provided with a head 19.

The operating section 9 includes an electromagnet 20 attached to a tubular or basket-shaped frame 21 which is connected to the housing 10 of the ejector unit. Inside the electromagnet 20 is an armature 22 which is rigidly connected to a rod 23 which, again, is rigidly connected to a sleeve 24. The sleeve has at one end an external flange 25, and a spring 26 is clamped between said flange and a fixed stop 21' in on the frame 21. The spring tends to keep the sleeve 24, the rod 23 and the armature 22 in a backwardly displaced position relative to the electromagnet 20.

At the opposite end of the sleeve 24 there is an internal flange 27 which defines a central aperture fitted to the threaded rod 18. The head 19 of the rod 18 is situated inside the sleeve 24 inwardly of the flange 27. Arranged on the threaded rod 18 are a stop nut 28 and a locking nut 29 therefor. The stop nut 28 serves as an abutment for the end surface 30 of the internal flange 27 of the sleeve 24.

The apparatus functions as follows.

It is presupposed that the pump has been running and that the space in the bore 11 ahead of the ejector piston 17 as well as the spaces inside the non-return valve 13 and on either side of the non-return valve 16 and the pressure conduit 3 stand filled with lubricant.

When the electromagnet 20 is accuated by an impulse from the timer 5 it will attract the armature 22 which will thereby, together with the rod 23 and the sleeve 24, be displaced towards the ejector section.

As the stop nut is situated at a distance A from the end surface 30 of the sleeve the armature will accelerate freely and without hindrance to a very high velocity before the end surface 30 impinges against the stop nut 28. When this happens the threaded rod will displace the ejector piston 17 with great force inwardly into the bore 11, whereby lubricant contained ahead of said piston will be ejected at high pressure via the non-return valve 16 through the pressure conduit to the nozzle 4 and via this nozzle towards the rail R.

It is possible to adjust the stroke length B of the ejector piston by adjusting the position of the stop nut 28 on the threaded rod 18. If the distance A between the end surface 30 and the stop nut 28 is increased the stroke length of the ejector piston 17 will be reduced. The armature 22 and the end surface are displaced a longer distance before the piston 17 is entrained. At the same time the flow speed of the lubricant through the conduit 3 and nozzle 4 increases since greater storage of kinetic energy can take place in the armature with the rod 23 and the sleeve 24. It is this kinetic energy that is utilized when the end surface 30 impinges against the stop nut 28.

Thus, the pump can be adjusted as required, it being possible to choose between large stroke volume and low counterpressure - low velocity and small stroke volume and high counterpressure - high velocity.

The construction of the pump renders the pump self-filling and self-sucking. The tank 1 therefore need not necessarily lie on a higher level than the pump. When an ejection has taken place the armature and the sleeve 24 are brought back to their initial position by the spring 26, and the threaded rod 18 with the ejector piston is entrained therewith. During the return movement the ejector piston produces an underpressure which secures refilling in the bore 11 and the passage 14, said underpressure cooperating with the static pressure in the lubricant tank 1.

The apparatus according to the invention permits using a nozzle 4 of small dimensions. The small size of the nozzle, together with the fact that the pump can, if desired, be situated at a relatively great distance therefrom, makes it possible to place the nozzle according to choice. In the embodiment shown the nozzle is directed towards the upper side of the rail. The small size of the nozzle also permits such mounting that ejection of lubricant can be directed towards the edge of the running path of the rail that is most exposed to wear. It is of course also possible, as has earlier been proposed, to let the nozzle eject the lubricant towards the tread or flange of the wheels of the vehicle.

The invention must not be considered limited to that described above and shown in the drawings but can be modified in various ways within the scope of the appendant claims.

What I claim and desire to secure by Letters Patent is:

1. Apparatus for portional ejection of lubricant for lubricating railway rails, comprising a tank for storing lubricant, an outlet in said tank, a dosage pump for ejecting lubricant having an inlet and an outlet, a passage connecting said tank outlet to said pump inlet to conduct lubricant from the tank to the pump, a nozzle operatively connectable to said pump outlet for dispensing lubricant ejected by said pump, said dosage pump comprising an ejector section body, a cylindrical bore in said body defining a dosage, an ejector piston operatively slidably disposed in said bore to eject lubricant therefrom through said pump outlet when said piston is reciprocated, an operating section frame member attached to said body, an electromagnet mounted on said frame member, an armature slidably mounted in said electromagnet to be reciprocated when said electromagnet is energized, an armature rod connected at one end to said armature, a sleeve member fixedly connected at one end to the other end of said armature rod, a radially inwardly extending flange on the other end of said sleeve member, a hollow chamber in said sleeve member between said ends thereof, a hole through said flange, a connecting rod attached at one end to said piston and extending slidably through said hole at the other end, a flanged head on said other end of said connecting rod within said chamber to retain said sleeve member on said connecting rod, an abutment member on said one end of said connecting rod which is attached to said piston a predetermined distance from said flange on said sleeve member and adapted to be engaged by said flange to reciprocate said piston to eject lubricant after said armature has been displaced said predetermined distance by energizing said electromagnet, a return spring operatively mounted between said frame member and said sleeve member to return said armature, sleeve member and piston after each ejection of lubricant, control means to energize said electromagnet at predetermined intervals, a check valve in said pump inlet to allow flow of lubricant into said bore of the ejector section body during the return stroke of said piston and prevent flow of lubricant to said tank during the ejection stroke, and a check valve in said pump outlet to allow flow of lubricant to said nozzle during the ejection stroke and prevent backflow of lubricant from said nozzle during the return stroke.

2. An apparatus as claimed in claim 1 wherein said connecting rod comprises a screw threaded rod, and said abutment member comprises an internally threaded abutment member cooperatively engaging said threaded rod so that it is adjustable on said threaded rod to vary said predetermined distance, said abutment member having a larger outside diameter than the diameter of said hole in said flange.

3. An apparatus as claimed in claim 2 wherein a radially inwardly directed annular fixed stop is provided on said frame member, a radially outwardly directed annular flange is provided on said sleeve member, said spring is a helical spring surrounding said sleeve member between and engaging said annular fixed stop and said outwardly directed annular flange at its ends, and said piston connecting rod, flange hole, chamber, sleeve member, and armature rod are coaxial.

* * * * *